US005529892A

United States Patent [19]

Massirio et al.

[11] Patent Number: 5,529,892

[45] Date of Patent: Jun. 25, 1996

[54] HARDENED SILVER HALIDE PHOTOGRAPHIC ELEMENTS

[75] Inventors: Sergio Massirio, Finale Ligure; Giovanni Giusto, Altare; Domenico Marinelli, Savona, all of Italy

[73] Assignee: Minnesota Mining and Manufacturing Company, St. Paul, Minn.

[21] Appl. No.: 554,072

[22] Filed: Nov. 6, 1995

[30] Foreign Application Priority Data

Dec. 16, 1994 [EP] European Pat. Off. ..... 94119893

[51] Int. Cl.[6] ..... G03C 1/30; G03C 1/047

[52] U.S. Cl. ..... 430/523; 430/539; 430/623; 430/629; 430/640; 430/642; 430/961

[58] Field of Search ..... 430/539, 623, 430/629, 640, 642, 523, 961

[56] References Cited

U.S. PATENT DOCUMENTS

| | | | |
|---|---|---|---|
| 4,018,609 | 4/1977 | Lohmer et al. | 430/539 |
| 4,063,952 | 12/1977 | Himmelmann et al. . | |

FOREIGN PATENT DOCUMENTS

| | | |
|---|---|---|
| 0197493A3 | 10/1986 | European Pat. Off. . |
| 0383347A2 | 8/1990 | European Pat. Off. . |
| 0578191A2 | 1/1994 | European Pat. Off. . |
| 5-265130 | 10/1993 | Japan . |

*Primary Examiner*—Thorl Chea

*Attorney, Agent, or Firm*—Gary L. Griswold; Walter N. Kirn; Mark A. Litman

[57] ABSTRACT

Light-sensitive silver halide photographic element comprising a support bearing at least a light-sensitive silver halide emulsion layer and at least a protective layer being further away from the support than every silver halide emulsion layer, said protective layer containing a gelatin having a viscosity lower than 20 milliPascal per seconds in 10 weight % aqueous solution at 40° C., said gelatin being hardened with a carbamoyl pyridinium salt compound having the following formula:

wherein $R_1$ and $R_2$, which may be the same or different, each represents an alkyl group, an aryl group or an aralkyl group, or $R_1$ and $R_2$, together, constitute the atoms required to form a heterocyclic ring with the nitrogen atom to which they are bonded, $R_3$ represents hydrogen atom, a halogen atom, an alkyl group, an alkoxy group, a carbamoyl group, or a ureido group, and $R_4$ represents an alkylene group or a single chemical bond between the pyridinium nucleus and the —$SO_3$— group.

6 Claims, No Drawings

HARDENED SILVER HALIDE PHOTOGRAPHIC ELEMENTS

FIELD OF THE INVENTION

The present invention relates to hardened silver halide photographic elements containing a low-viscosity gelatin.

BACKGROUND OF THE INVENTION

Photographic light-sensitive materials make use of proteins and, in particular, gelatin as binders. For example, gelatin is used as the main component of silver halide emulsion layers, protective layers, filter layers, intermediate layers, antihalation layers, backing layers and subbing layers of photographic light-sensitive materials.

It is known that the mechanical properties of gelatin-containing layers of photographic materials can be improved by addition of hardening agent. In fact, the photographic materials may be stored at elevated temperatures and humidity conditions or treated with various aqueous solutions having different pH's and temperatures, and gelatin layers which have not been treated with a hardening agent have poor water resistance, heat resistance and abrasion resistance.

Many compounds are known to be effective for increasing mechanical resistance of a gelatin layer by hardening. They include, for example, metal salts such as chromium, aluminum and zirconium salts; aldehydes such as formaldehyde and glutaraldehyde; halogenocarboxyaldehydes such as mucochloric acid; aziridine compounds such as those described in U.S. Pat. No. 3,017,280; epoxy compounds such as those described in U.S. Pat. No. 3,091,537; halogenotriazine compounds such as hydroxydichlorotriazine and aminodichlorotdazine; and compounds having vinylsulfonyl groups such as methylene-bis-vinylsulfone, divinylsulfone and methylene-bis-vinyl-sulfonamide.

A group of hardening agents for photographic gelatin-containing layers which is particularly interesting has been disclosed in U.S. Pat. No. 4,063,952. These hardening agents are carbamoyl pyridinium compounds in which the pyridine ring carries a sulfo or sulfoalkyl group. These compounds have a high water solubility, a fast hardening action for gelatin and low occurrence of post-hardening (post-hardening is the change of hardening degree caused by slow continued hardening of the gelatin). They belong to the group of the so-called "fast acting" hardeners, with which the light-sensitive photographic materials can be hardened to an optimum degree within a very short time.

Owing to this rapid action, said fast acting hardeners generally should only be added to the gelatin containing casting solutions shortly before casting because otherwise a premature reaction would take place which would rapidly and irreversibly affect the casting properties, in particular the viscosity of the casting solutions.

The interaction of hardeners with the gelatin of the protective layer of a silver halide photographic material is known as a critical point: some solutions have been proposed in the past for conventional hardeners, such as triazine type hardeners (see, for example, U.S. Pat. Nos. 3,749,573; 4,944,966 and JP 59-151,151). These hardeners are either added to a gelatin-containing solution before the coating process, or applied, as a special coating, to a gelatin-containing layer already on the support material. However, this technology is not sufficient to avoid coating defects for fast acting hardeners belonging to the class of carboxyl activating hardener. In fact, due to the presence of restricted flow areas in the feeding line and in the coater which can not be completely eliminated, and due to the thin film of the liquid stream which adheres to the wall of the feeding line and of the coater, some portions of the liquid stream is characterized by a longer permanence time before coating. If this fact does not generate criticality with conventional hardeners, hardeners characterized by a faster kinetic of reaction with gelatin, such as the carboxyl activating type hardener, result in the formation of microgels which are occasionally stripped out from the liquid stream and reach the coater, where they generate defects of various types. To avoid this problem, it is necessary to periodically stop the production and clean the feeding line and the coater, thus reducing productivity.

U.S. Pat. No. 4,942,068 discloses a way to fully exploit the good performances of fast acting hardeners; it involves the introduction of the hardener through a dedicated layer of specific gelatin content and using a V-shaped coater for curtain coating. The hardening layer is guided at-the negatively inclined surface of the V-shaped coater, at the opposite side of the sensitive layers; the hardening and the sensitive layer meet at the edge of the coater without generating coagulation. As a prior art statement, said patent discloses that the hardener has to be applied in a separate coating solution containing from 0 to 4% by weight, preferably from 0.5 to 1% by weight gelatin or gelatin derivatives either as an additional layer or as a part of a layer packet, in which the adjacent layers also have gelatin concentrations of at most only 4% by weight. Without this condition, it is necessary to apply the hardener in a second coating solution, after drying or with a separate passage through the machine.

EP 285,994 describes a photographic material with top coat containing alkali hydrolized gelatin having specified viscosity and swelling factor to avoid reticulation and soiling. The material is hardened with a fast acting hardener of the carbamoyl-pyridinium type. The gelatin used in the topcoat is alkali-hydrolized bone gelatin having viscosity higher than 20.0 milliPascal per seconds, when measured in 10 weight % aqueous solution at 40° C.

U.S. Pat. No. 4,421,847 discloses a process for chain-lengthening of gelatin in which the gelatin is brought into contact with a hardening agent which can activate the carboxyl groups of the gelatin. The so obtained partially hardened gelatin has advantageous properties as for the production of photographic layers.

U.S. Pat. No. 4,865,940 describes a color photographic recording material having at least one layer of binder and a dispersion of hardened particles of a complex coacervate (packet emulsion) in this layer of binder, wherein said particles of complex coacervate contain at least one carboxylic and amino group-containing proteinaceous polymeric binder and are hardened with a carbamoyl-pyridinium type hardener. The dispersion of hardened particles can easily be rehomogenized after concentration.

U.S. Pat. No. 4,119,464 discloses a process by which photographic layers can be hardened with carboxyl activating hardener, without the disadvantage resulting from the use of the large quantities of hardeners normally required for a fast acting hardening reaction. Said process includes the step, before applying the fast acting hardener, of incorporating in the surface of a photographic layer which contains gelatin, a pre-hardener selected from the group consisting of complex forming salts of aluminum, chromium and zirconium.

U.S. Pat. No. 5,034,249 discloses proteinaceous binders, in particular gelatin layers used in photographic recording materials, hardened by means of a fast acting hardener by casting a hardening system composed of at least two layers over the layer of binder, the lower of these two layers contains the fast acting hardener while the upper layer, which may be applied together with or immediately after the lower layer, contains a protein-containing binder but no hardener. The hardened layers have improved surface properties, such as wet scratch resistance and antifriction properties, U.S. Pat. No. 4,978,607 describes a photographic recording material which comprises at least one gelatin containing silver halide emulsion layer and at least one protective layer containing a gelatin derivative, the protective layer being further away from the layer support than each silver halide emulsion layer and 30 to 90% of the amino groups of the gelatin in the gelatin derivative being reacted with a monofunctional acid derivative, and which is hardened with a fast acting hardener. The photographic material can be produced at high speed and, hence, at high drying temperatures without any reticulation grain occurring during processing.

DE 3,836,945 describes a photographic material with outer hardening coat containing thickener which is inert towards fast acting hardener and little or no gelatin to reduce soiling during processing.

DE 3,714,600 discloses a photographic silver halide material with double protective coat, the lower protective coat containing acid-ashed gelatin and surfactant polyalkylene oxide to prevent reticulation and soiling, while the upper protective coat contains a fast acting hardener and an acid-ashed gelatin (isoelectric point pH 5.0) or an alkali-ashed gelatin (isoelectric point pH 7.0–9.0).

DE 3,914,947 describes a photographic silver halide material with outer hardening coat containing both sulfoethylcellulose which is inert to fast acting hardener and anionic surfactant to reduce soiling.

It could be desirable to use a type of gelatin and a class of hardeners which combined together do not significantly affects the physical-mechanical properties of the film allowing in the meanwhile to optimize the use of fast acting hardeners.

SUMMARY OF THE INVENTION

In accordance with the present invention there is provided a light-sensitive silver halide photographic element comprising a support bearing at least one light-sensitive silver halide emulsion layer and at least a protective layer being further away from the support than each silver halide emulsion layer, said protective layer containing a gelatin having a viscosity lower than 20 milliPascal per seconds in 10 weight % aqueous solution at 40° C., said gelatin being hardened with carbamoyl pyridinium salt compounds having the formula:

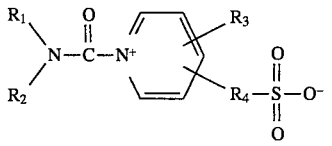

(Formula I)

wherein $R_1$ and $R_2$, which may be the same or different, each represents an alkyl group, an aryl group or an aralkyl group, or $R_1$ and $R_2$, together with the nitrogen atom to which they are bonded, constitute the atoms required to form a heterocyclic ring, $R_3$ represents hydrogen atom, a halogen atom, an alkyl group, an alkoxy group, a carbamoyl group, a ureido group, and $R_4$ represents an alkylene group or a single chemical bond.

The combination of the gelatin and the carbamoyl pyridinium salt compounds used in the photographic element of the present invention allows said gelatin to maintain a low-viscosity also after several hours the mixing of the gelatin and the carbamoyl pyridinium salt compounds, without affecting the physical-mechanical properties of the film.

DETAILED DESCRIPTION OF THE INVENTION

In Formula I, $R_1$ and $R_2$, which may be the same or different, each represents an alkyl group, preferably having from 1 to 10 carbon atoms (e.g., methyl, ethyl, 2-ethylhexyl, etc.), an aryl group, preferably having from 6 to 15 carbon atoms (e.g., phenyl, naphthyl, etc.), an aralkyl group, preferably having from 7 to 15 carbon atoms (e.g., benzyl, phenethyl, etc.) or $R_1$ and $R_2$, together with the nitrogen atom, constitute the atoms required to form a heterocyclic ring, (e.g., pyrrolidine, morpholine, piperidine, piperazine, 1,2,3,4-tetrahydroquinone ring, etc.).

$R_3$ represents a substituent such as hydrogen atom, a halogen atom, an alkyl group having from 1 to 10 carbon atoms (e.g., methyl, ethyl, etc.), an alkoxy group having from 1 to 10 carbon atoms, a carbamoyl group, a ureido group, etc., and $R_4$ represents an alkylene group having from 1 to 4 carbon atoms (e.g., methylene, ethylene, propylene) or a single chemical bond between the pyridinium nucleus and the —$SO_3$— group.

When the term "group" or "ring" is used in the present invention, the described chemical material includes the basic group or ring and that group or ring with conventional substituents. For example, "alkyl group" includes not only such alkyl moieties as methyl, ethyl, octyl, stearyl, etc. but also such moieties bearing substituents groups such as halogen, cyano, hydroxyl, nitro, amine, carboxylate, etc.

Practical examples of carbamoyl pyridinium salt compounds as hardening agents, which can be prepared according to the process described in U.S. Pat. No. 4,063,952 or in DD 290,879, are illustrated below, but the invention is not limited to these compounds.

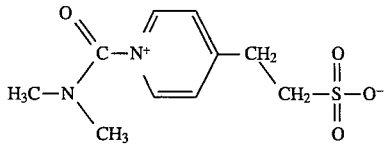

(1)

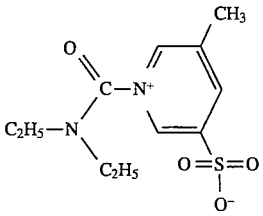

(2)

-continued (3)

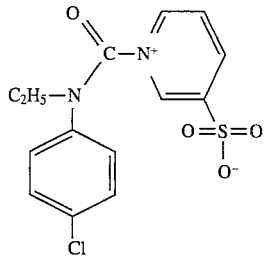

(4)

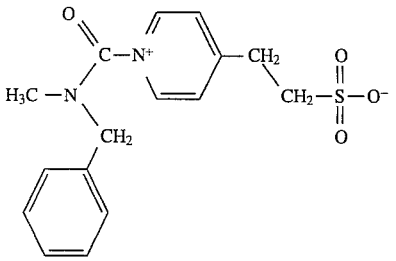

(5)

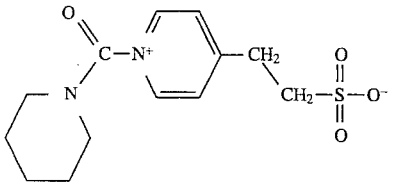

(6)

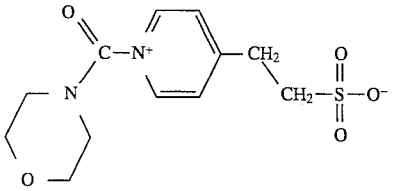

(7)

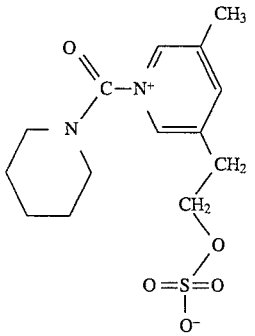

(8)

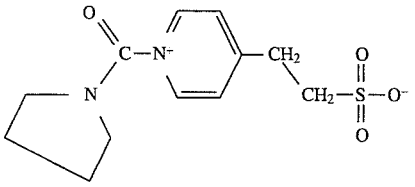

(9)

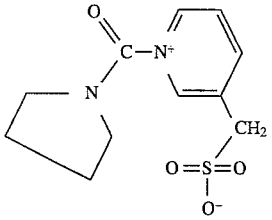

-continued (10)

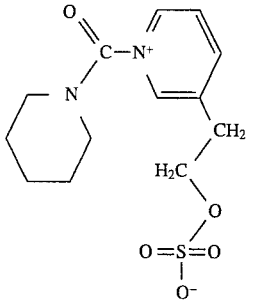

(11)

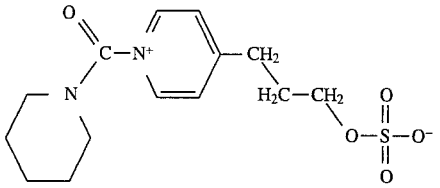

(12)

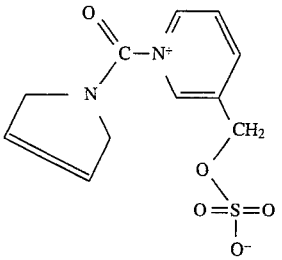

(13)

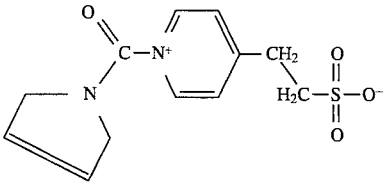

(14)

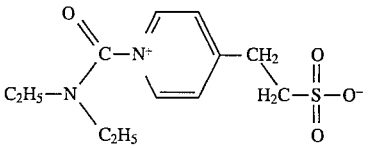

The amount of the hardening agent in the present invention is not particularly limited, but can be selected freely depending on the intended purpose. The amount used generally ranges from 0.1 to 20%, preferably 0.2 to 10%, by weight with respect to the weight of the dry gelatin in the photographic element.

The carbamoylpyridinium hardener can be used singly or as a mixture of two or more such hardeners thereof. Also, they can be used together with conventionally known hardening agents, as those aforesaid described.

The hardening agents in the present invention can be incorporated in gelatin layers of the photographic elements in various ways, for example, by adding the hardening agents to a gelatin composition before coating or by dipping a dried gelatin layer into a hardener solution.

The hardened silver halide emulsion of the present invention can be used for every photographic element, such as color photographic elements (for example, color photographic negative films, color photographic reversal films, color photographic positive films, color photographic papers and reversal papers), black and white photographic elements (for example black and white photographic films, radiographic photographic films, lithographic films, black and white photographic papers and micrographic films), etc.

Preferred silver halide photographic elements are multilayer color photographic elements comprising a blue sensitive silver halide emulsion layer associated with yellow dye-forming color couplers, a green sensitive silver halide emulsion layer associated with magenta dye-forming color couplers and a red sensitive silver halide emulsion layer associated with cyan dye-forming color couplers. Each layer can be comprised of a single emulsion layer or of multiple emulsion sub-layers sensitive to a given region of visible spectrum. When multilayer materials contain multiple blue, green or red sub-layers, there can be in any case relatively faster and relatively slower sub-layers. At least one protective layer is positioned further away from the support than each silver halide emulsion layer. A non-photosensitive intermediate layer, which may contain agents to prevent the unwanted diffusion of developer oxidation products, is generally arranged between layers of different spectral sensitivity. A non-photosensitive yellow filter layer is generally arranged between the green-sensitive layers and the blue-sensitive layers. However, other arrangements are also possible.

When using multilayer color photographic elements, it is contemplated in the present invention to have at least a protective layer comprising a low-viscosity gelatin hardened by the carbamoylpyridinium salt compounds described above. Said gelatin has a viscosity lower than 20 milliPascal per seconds, in 10 weight % aqueous solution at 40° C., preferably lower than 15 milliPascal per seconds. The measurement has been done by using a concentric vessel rotatory viscometer.

In all the layers different from the said protective layer of the photographic element of the present invention, where said low-viscosity gelatin hardened by carbamoylpyridinium salts is present, any kind of gelatin can be employed. In general, gelatin is classified as alkaline gelatin (i.e. a lime bone inert gelatin) which is obtained from collagen, for example by treatment with calcium hydroxoide, acidic gelatin which is obtained by acidic treatment, for example with hydrochloric acid, enzymatic gelatin which is treated, for example, with a hydrolase, and low molecular weight gelatin which is obtained by further hydrolysis of the gelatins mentioned above by different methods. The final gelatin is obtained from the digested mass by extraction with warm water, evaporation of the solution and drying of the residue (see, for example, G. A. Wards & A. Courts "The Science and Technology of Gelatin", Academic Press, 1977).

Gelatin is usually a fairly heterogeneous mixture of polypeptides with molecular weights scattered within a wide range. The skin and demineralized animal bones (ossein) used as starting materials for the preparation of gelatin contain tropocollagen as the most important constituent, as described in U.S. Pat. No. 4,352,695. Tropocollagen is a well-defined macromolecule consisting of three polypeptide chains linked to one another (two $\alpha_1$-chains and one $\alpha_2$-chain), and the build-up and aminoacid sequence of these chains are accurately known.

Hydrophilic polymers conventionally used in photography can be advantageously employed as a partial replacement of conventional gelatin derivative such as acylated gelatin, graft gelatin, etc., albumin, gum arabic, agar agar, a cellulose derivative, such as hydroxyethyl-cellulose, carboxymethyl-cellulose, etc., a synthetic resin, such as polyvinyl alcohol, polyvinylpyrrolidone, polyacrylamide, etc.

In said multilayer color photographic elements, suitable color couplers are preferably selected from the couplers having diffusion preventing groups, such as groups having a hydrophobic organic residue of about 8 to 32 carbon atoms, introduced into the coupler molecule in a non-splitting-off position. Such a residue is called a "ballast group". The ballast group is bonded to the coupler nucleus directly or through an imino, ether, carbonamido, sulfonamido, ureido, ester, imido, carbamoyl, sulfamoyl bond, etc. Examples of suitable ballasting groups are described in U.S. Pat. No. 3,892,572.

To disperse the couplers into the silver halide emulsion layer, conventional coupler in oil dispersion methods well-known to the skilled in the art can be employed. Said methods, described for example in U.S. Pat. Nos. 2,322,027; 2,801,170; 2,801,171 and 2,991,177, consist of dissolving the coupler in a water-immiscible high boiling organic solvent (the "oil") and then mechanically dispersing such a solution in a hydrophilic colloidal binder under the form of small droplets having average sizes in the range from 0.1 to 1, preferably from 0.15 to 0.3 μm. The preferred colloidal binder is gelatin, even if other kinds of binders can also be used.

Said non-diffusible couplers are introduced into the light-sensitive silver halide emulsion layers or into non-light-sensitive layers adjacent thereto. On exposure and color development, said couplers give a color which is complementary to the light color to which the silver halide emulsion layers are sensitive. Consequently, at least one non-diffusible cyan-image forming color coupler, generally a phenol or an α-naphthol compound, is associated with red-sensitive silver halide emulsion layers, at least one non-diffusible magenta image-forming color coupler, generally a 5-pyrazolone or a pyrazolotriazole compound, is associated with green-sensitive silver halide emulsion layers and at least one non-diffusible yellow image forming color coupler, generally a acylacetanilide compound, is associated with blue-sensitive silver halide emulsion layers.

Said color couplers may be 4-equivalent and/or 2-equivalent couplers, the latter requiring a smaller amount of silver halide for color production. As is well known, 2-equivalent couplers derive from 4-equivalent couplers since, in the coupling position, they contain a substituent which is released during coupling reaction. 2-Equivalent couplers which may be used in the present invention include both those substantially colorless and those which are colored ("masked couplers"). The 2-equivalent couplers also include white couplers which do not form any dye on reaction with the color developer oxidation products. The 2-equivalent color couplers include also DIR couplers which are capable of releasing a diffusing development inhibiting compound on reaction with the color developer oxidation products.

Examples of cyan couplers which can be used in the present invention can be selected from those described in U.S. Pat. Nos. 2,369,929; 2,474,293; 3,591,383; 2,895,826; 3,458,315; 3,311,476; 3,419,390; 3,476,563 and 3,253,924; and in British patent 1,201,110.

Examples of magenta couplers which can be used in the present invention can be selected from those described in U.S. Pat. Nos. 2,600,788; 3,558,319; 3,468,666; 3,419,301; 3,253,924 and 3,311,476 and in British patents 1,293,640; 1,438,459 and 1,464,361.

Examples of yellow couplers which can be used in the present invention can be selected form those described in U.S. Pat. Nos. 3,265,506, 3,278,658, 3,369,859, 3,528,322, 3,408,194, 3,415,652 and 3,235,924, in German patent applications 1,956,281, 2,162,899 and 2,213,461 and in British Patents 1,286,411, 1,040,710, 1,302,398, 1,204,680 and 1,421,123.

Colored cyan couplers which can be used in the present invention can be selected from those described in U.S. Pat. Nos. 3,934,802; 3,386,301 and 2,434,272.

Colored magenta couplers which can be used in the present invention can be selected from the colored magenta couplers described in U.S. Pat. Nos. 2,434,272; 3,476,564 and 3,476,560 and in British patent 1,464,361.

Colorless couplers which can be used in the present invention can be selected from those described in British patents 861,138; 914,145 and 1,109,963 and in U.S. Pat. No. 3,580,722.

Examples of DIR couplers or DIR coupling compounds which can be used in the present invention include those described in U.S. Pat. Nos. 3,148,062; 3,227,554; 3,617,291; in German patent applications Ser. Nos. 2,414,006; 2,659,417; 2,527,652; 2,703,145 and 2,626,315; in Japanese patent applications Ser. Nos. 30,591/75 and 82,423/77 and in British patent 1,153,587.

Examples of non-color forming DIR coupling compounds which can be used in the present invention include those described in U.S. Pat. Nos. 3,938,996; 3,632,345; 3,639,417; 3,297,445 and 3,928,041; in German patent applications Ser. Nos. 2,405,442; 2,523,705; 2,460,202; 2,529,350 and 2,448,063; in Japanese patent applications Ser. Nos. 143,538/75 and 147,716/75 and in British patents 1,423,588 and 1,542,705.

The silver halide emulsion used in this invention may be a fine dispersion of silver chloride, silver bromide, silver chloro-bromide, silver iodo-bromide and silver chloro-iodo-bromide in a hydrophilic binder. Preferred silver halides are silver iodo-bromide or silver iodo-bromo-chloride containing I to 20 % mole silver iodide. The silver halide grains may have any crystal form such as cubic, octahedral, tabular or a mixed crystal form. The silver halide can have a uniform grain size or a broad grain size distribution. The size of the silver halide ranges from about 0.1: to about 5 μm. The silver halide emulsion can be prepared using a single-jet method, a double-jet method, or a combination of these methods and can be matured using, for instance, an ammonia method, a neutralization method, an acid method, etc. The emulsions which can be used in the present invention can be chemically and optically sensitized as described in Research Disclosure 17643, III and IV, December 1978; they can contain optical brighteners, antifogging agents and stabilizers, filtering and antihalo dyes, hardeners, coating aids, plasticizers and lubricants and other auxiliary substances, as for instance described in Research Disclosure 17643, V, VI, VIII, X, XI and XII, December 1978. The layers of the photographic emulsion and the layers of the photographic element can contain various colloids, alone or in combination, such as binding materials, as for instance described in Research Disclosure 17643, IX, December 1978. The above described emulsions can be coated onto several support bases (cellulose triacetate, paper, resin-coated paper, polyester included) by adopting various methods, as described in Research Disclosure 17643, XV and XVII, December 1978. The light-sensitive silver halides contained in the photographic elements of the present invention after exposure can be processed to form a visible image by associating the silver halide with an aqueous alkaline medium in the presence of a developing agent contained in the medium or in the element. Processing formulations and techniques are described in Research Disclosure 17643, XIX, XX and XXI, December 1978.

The present invention will be now illustrated in greater detail by reference to the following examples.

EXAMPLE 1

Different types of gelatin were considered:

Gelatin 1 was a reference gelatin, lime bone inert gelatin;

Gelatin 2 was a high viscosity lime bone inert gelatin;

Gelatin 3 was a low viscosity lime bone inert gelatin;

Gelatin 4 was the low-viscosity "Acid Ossein A779" gelatin commercialized by Chroda Co;

Gelatin 5 was the low-viscosity "Acid Ossein AR834" antireticulation gelatin commercialized by Roussellot Co.;

Gelatin 6 was the low-viscosity "Acid Ossein AR929" antireticulation gelatin commercialized by Roussellot Co.

The different characteristics of the gelatins are reported in Table 1. The viscosity is measured in milliPascal per seconds, in 10.0 weight % aqueous solution at 40° C. by a concentric vessel rotatory viscometer. The isoelectric point is the pH value related to the condition of electroneutrality at which the gelatin will not migrate to either electrode in a cell.

TABLE 1

| Gelatin | Viscosity mPa · s | Isoelectric Point |
|---|---|---|
| 1 | 24.24 | 5.00 |
| 2 | 47.17 | 5.00 |
| 3 | 13.48 | 5.00 |
| 4 | 13.05 | 7.20 |
| 5 | 12.04 | 6.60 |
| 6 | 11.61 | 7.86 |

Different compositions 1–7 for coating of topcoat layers of a color photographic material were prepared using 232.3 ml of water, 11.05 g of gelatin and 4.86 g of hardener as described in Table 2. In order to evaluate the criticity of the interaction between the coating composition containing the gelatin and the hardener, a suitable procedure consisted in the measurement of the viscosity of the coating composition at different times (from 0 to 5 hours) after the addition of the hardener. The viscosity is measured in milliPascal per seconds, in 6.67 weight % aqueous solution at 40° C. by a concentric vessel rotatory viscometer. The results are shown in Table 2.

TABLE 2

| | | Hard- | Viscosity | | | | | |
|---|---|---|---|---|---|---|---|---|
| Comp. | Gelatin | ener | 0 H | 1 H | 2 H | 3 H | 4 H | 5 H |
| 1 (ref.) | 1 | H-1 | 2.97 | 2.97 | 3.60 | 4.42 | 5.11 | 6.24 |
| 2 (ref.) | 2 | 1 | 5.55 | 7.50 | 13.20 | coag. | coag. | coag. |
| 3 (inv.) | 3 | 1 | 2.97 | 2.97 | 2.97 | 3.60 | 5.11 | 5.55 |
| 4 (inv.) | 4 | 1 | 2.97 | 2.97 | 2.97 | 3.60 | 5.11 | 6.00 |
| 5 (inv.) | 5 | 1 | 2.97 | 2.97 | 2.97 | 2.97 | 3.60 | 4.42 |
| 6 (inv.) | 6 | 1 | 2.97 | 2.97 | 2.97 | 3.07 | 3.68 | 4.55 |
| 7 (ref.) | 1 | 1 | 2.97 | 4.00 | 5.90 | 8.20 | 13.92 | coag. |

Table 2 shows that samples 3 to 6 of the present invention (containing protective layers containing a low-viscosity gelatin and a carbamoyl pyridinium hardener) maintain a viscosity lower than the viscosity of the reference sample 1, also after several hours after the mixing of the gelatin and the hardener. On the contrary, samples 2 and 7 (containing the same carbamoyl pyridinium hardener, but not containing a low-viscosity gelatin) tend to reach a viscosity too high after mixing, generating an undesired coagulation.

Hardener H-1

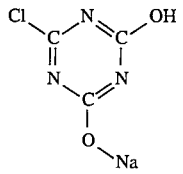

EXAMPLE 2

Sample A (Comparison)

A multilayer negative color film was prepared by coating a cellulose triacerate support base, subbed with gelatin, with the following layers in the following order:

(a) a layer of black colloidal silver dispersed in gelatin having a silver coverage of 0.27 g/m$^2$ and a gelatin coverage of 1.33 g/m$^2$;

(b) an intermediate layer containing 0.97 g/m$^2$ of gelatin;

(c) a layer of low sensitivity red-sensitive silver halide emulsion comprising a sulfur and gold sensitized low-sensitivity silver bromoiodide emulsion (having 2.5% silver iodide moles and a mean grain size of 0.18 μm) at a total silver coverage of 0.71 g/m$^2$ and a gelatin coverage of 0.94 g/m$^2$, containing the cyan-dye forming coupler C-1 at a coverage of 0.354 g/m$^2$, the cyan-dye forming DIR coupler C-2 at a coverage of 0.024 g/m$^2$ and the magenta colored cyan-dye forming coupler C-3 at a coverage of 0.052 g/m$^2$, dispersed in a mixture of tricresylphosphate and butylacetanilide;

(d) a layer of medium-sensitivity red-sensitive silver halide emulsion comprising a silver chloro-bromo-iodide emulsion (having 7% silver iodide moles and silver chloride moles and a mean grain size of 0.45 μm) at a silver coverage of 0.84 g/m$^2$ and a gelatin coverage of 0.83 g/m$^2$, containing the cyan-dye forming coupler C-1 at a coverage of 0.333 g/m$^2$, the cyan-dye forming DIR coupler C-2 at a coverage of 0.022 g/m$^2$ and the magenta colored cyan-dye forming coupler C-3 at a coverage of 0.052 g/m$^2$, dispersed in a mixture of tricresylphosphate and butylacetanilide;

(e) a layer of high-sensitivity red-sensitive silver halide emulsion comprising a silver bromo-iodide emulsion (having 12% silver iodide moles and a mean grain size of 0.11 μm) at a silver coverage of 1.54 g/m$^2$ and a gelatin coverage of 1.08 g/m$^2$, containing two cyan-dye forming couplers, the coupler C-1 at a coverage of 0.224 g/m$^2$ and the coupler C-4 at a coverage of 0.032 g/m$^2$, and the cyan-dye forming DIR coupler C-2 at a coverage of 0.018 g/m$^2$, dispersed in a mixture of tricresylphosphate and butylacetanilide;

(f) an intermediate layer containing 1.11 g/m$^2$ of gelatin and the gelatin hardener H-1 at a coverage of 0.092 g/m$^2$;

(g) a layer of low sensitivity green sensitive silver halide emulsion comprising a blend of 63% w/w of the low-sensitivity emulsion of layer c) and 37% w/w of the medium-sensitivity emulsion of layer (d) at a silver coverage of 1.44 g/m$^2$ and a gelatin coverage of 1.54 g/m$^2$, containing the magenta-dye forming coupler M-1, at a coverage of 0.537 g/m$^2$, the magenta dye forming DIR coupler M-2 at a coverage of 0.017 g/m$^2$, the yellow colored magenta dye forming coupler M-3 at a coverage of 0.021 g/m$^2$ and the yellow colored magenta dye forming coupler M-4 at a coverage of 0.043 g/m$^2$, dispersed in tricresylphosphate;

(h) a layer of high-sensitivity green sensitive silver halide emulsion comprising the emulsion of layer (e) at a silver coverage of 1.60 g/m$^2$ and a gelatin coverage of 1.03 g/m$^2$ containing the magenta dye forming coupler M-1, at a coverage of 0.498 g/m$^2$, the magenta dye forming DIR coupler M-2 at a coverage of 0.016 g/m$^2$, the yellow colored magenta dye forming coupler M-3 at a coverage of 0.021 g/m$^2$, and the yellow colored magenta dye forming coupler M-4 at a coverage of 0.043 g/m$^2$, dispersed in tricresylphosphate;

(i) an intermediate layer containing 1.06 g/m$^2$ of gelatin;

(j) a yellow filter layer containing 1.18 g/m$^2$ of gelatin, comprising the gelatin hardener H-1 at a coverage of 0.074 g/m$^2$;

(k) a layer of low-sensitivity blue-sensitive silver halide emulsion comprising a blend of 60% w/w of the low-sensitivity emulsion of layer c) and 40% w/w of the medium-sensitivity emulsion of layer (d) at a silver coverage of 0.53 g/m$^2$ and a gelatin coverage of 1.65 g/m$^2$ and the yellow dye forming coupler Y-1 at a coverage of 1.042 g/m$^2$ and the yellow dye forming DIR coupler Y-2 at a coverage of 0.028 g/m$^2$ dispersed in a mixture of diethyllaurate and dibutylphthalate;

(l) a layer of high-sensitivity blue sensitive silver halide emulsion comprising the emulsion of layer (e) at a silver coverage of 0.90 g/m$^2$ and a gelatin coverage of 1.24 g/m$^2$, containing the yellow dye-forming coupler Y-1 at a coverage of 0.791 g/m$^2$ and the yellow dye forming DIR coupler Y-2 at a coverage of 0.021 g/m$^2$ dispersed in a mixture of diethyllaurate and dibutylphthalate;

(m) a protective layer of 1.28 g/m$^2$ of gelatin; and (n) a top coat layer of 0.73 g/m$^2$ of gelatin 1 containing 0.273 g/m$^2$ of polymethylmethacrylate matting agent in form of beads, and the hardener H-1 at a coverage of 0.233 g/m$^2$.

The total silver coverage was 6.99 g/m$^2$.

Sample B (Invention)

A multilayer negative color film was prepared as Sample A, but, in the layer (n), the reference hardener H-1 and the reference gelatin 1 were replaced, respectively, by 0.466 g/m$^2$ of hardener 1 and by the acid ossein gelatin 5 according to the present invention.

Sample C (Invention)

A multilayer negative color film was prepared as Sample B, but the acid ossein gelatin 6 replaced the acid ossein gelatin 5, according to the present invention.

Sample D (Invention)

A multilayer negative color film was prepared as Sample A, but the acid ossein gelatin 6 replaced the lime treated gelatin 1 in the layer (n), and the reference hardener H-1 was replaced by 0.154 g/m$^2$, 0.122 g/m$^2$ and 0.356 g/m$^2$ of hardener 1 according to the present invention, respectively, in layers (n), (f) and (j).

Sample E (Invention)

A multilayer negative color film was prepared as Sample A, but, in the layer (n), the reference hardener H-1 and the reference gelatin 1 were replaced, respectively, by 0.631 g/m$^2$ of hardener 1 and by the acid ossein gelatin 6, without hardeners in layers (f) and (j).

Samples of each film were exposed for a 1/20 of a second to a light source having a color temperature of 5,500-Kelvin through an optical step wedge. All the exposed samples were developed in a standard type C41 process as described in *British Journal of Photography,* Jul. 12, 1974, pp. 597–598. The samples were then sensitometrically examined: S1 is the sensitivity value measured in Log E, wherein E is expressed in lux-seconds at a density of 0.2 above Dmin, while S2 has been measured in the same way, but at a density of 1.0 above Dmin. The physical and sensitometric results are reported in Table 3. The hardness was measured 24 hours after the coating with a particular instrument provided with a Shapire stylus which engraves the sample imbibed with a liquid composition, water or processing solution, where it has been kept at 38° C. for 4 minutes. The hardness values are expressed in grams loaded on the stylus to engrave the sample: the higher the weight, the harder the material.

TABLE 3

| Film | Gelatin | Hard-ener | Dorn-berg Hard-ness | Dmin | Dmax | $S_1$ | $S_2$ |
|---|---|---|---|---|---|---|---|
| A (ref.) | 1 | H-1 | 160 | 0.85 | 3.21 | 22.3 | 10.7 |
| B (inv.) | 5 | 1 | 173 | 0.81 | 3.22 | 22.7 | 11.5 |
| C (inv.) | 6 | 1 | 170 | 0.82 | 3.23 | 22.8 | 11.8 |
| D (Inv.) | 6 | 1 | 170 | 0.82 | 3.22 | 22.8 | 11.7 |
| E (inv.) | 6 | 1 | 170 | 0.82 | 3.23 | 22.8 | 11.8 |

Table 3 shows that samples B, C, D and E of the present invention (containing a low-viscosity gelatin hardened by a carbamoyl pyridinium hardener in the protective layer) have better sensitometric properties, particularly in terms of Dmin and speed, than sample A (containing a reference gelatin hardened by a reference hardener in the protective layer).

Magenta dye forming Coupler M-1:

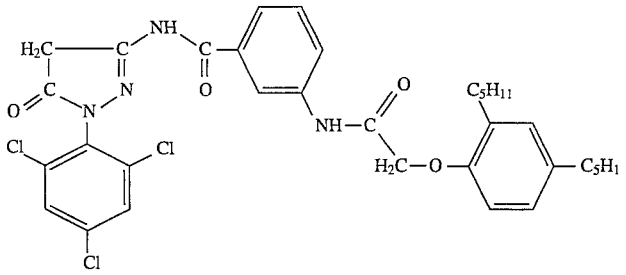

Magenta dye forming DIR Coupler M-2:

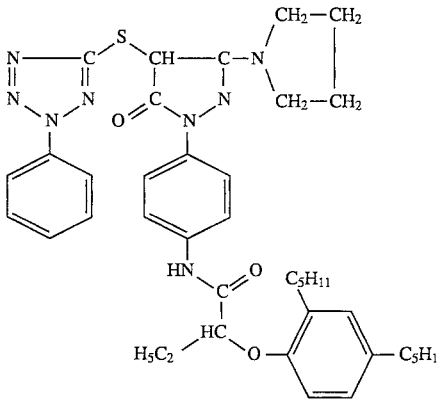

Yellow colored magenta dye forming Coupler M-3:

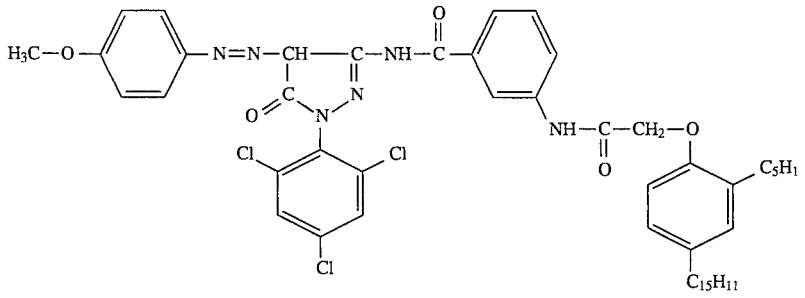

-continued
Yellow colored magenta dye forming Coupler M-4:
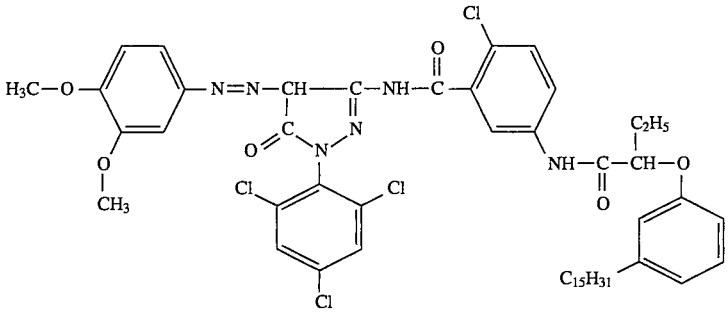
Yellow dye forming DIR Coupler Y-2:
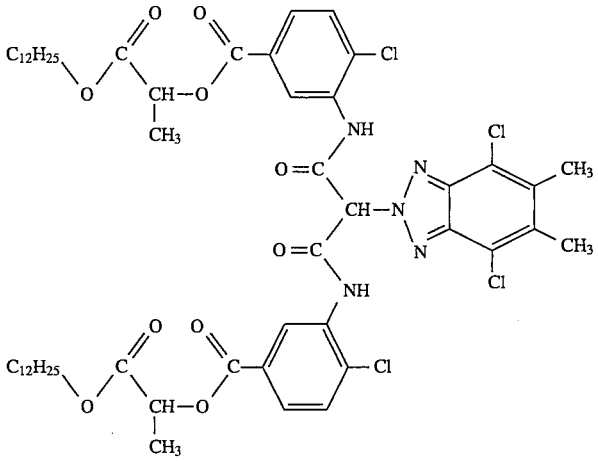
Cyan dye forming Coupler C-1:
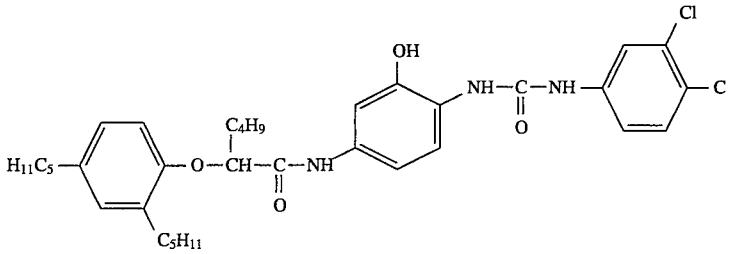
Cyan dye forming DIR Coupler C-2:
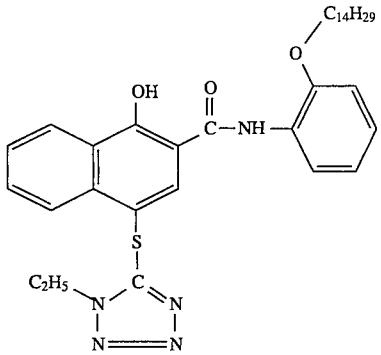

-continued

Magenta colored cyan-dye forming Coupler C-3:

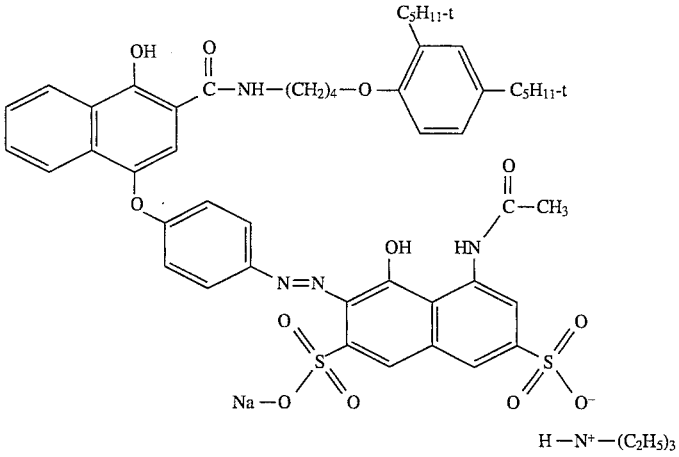

Cyan dye forming Coupler C-4:

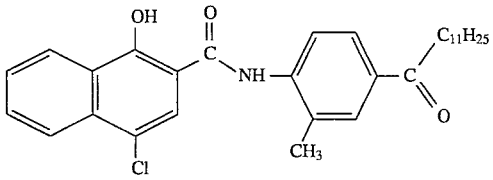

Yellow Dye Forming Coupler Y-1:

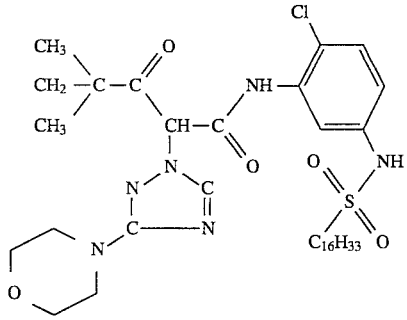

We claim:

1. A light-sensitive silver halide photographic element comprising a support bearing at least a light-sensitive silver halide emulsion layer and at least a protective layer being further away from the support than all silver halide emulsion layers, said protective layer containing a gelatin having a viscosity lower than 20 milliPascal per seconds in 10 weight % aqueous solution at 40° C., said gelatin being hardened with at least one carbamoyl pyridinium salt compound having the following formula:

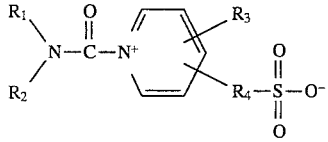

wherein $R_1$ and $R_2$, which may be the same or different, each represents an alkyl group, an aryl group or an aralkyl group, or $R_1$ and $R_2$, together, constitute the atoms required to form a heterocyclic ring with the nitrogen atom to which they are bonded, $R_3$ represents hydrogen atom, a halogen atom, an alkyl group, an alkoxy group, a carbamoyl group, or a ureido group, and $R_4$ represents an alkylene group or a single chemical bond between the pyridinium nucleus and the $—SO_3—$ group.

2. A light-sensitive silver halide photographic element of claim 1, wherein said gelatin has a viscosity lower than 15 milliPascal per seconds in 10 weight % aqueous solution at 40° C.

3. A light-sensitive silver halide photographic element of claim 1, wherein the carbamoyl pyridinium salt compound corresponds to the following formula:

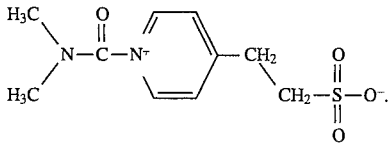

4. A light-sensitive silver halide photographic element of claim 1, wherein the carbamoyl pyridinium salt compound is added in an amount of 0.1 to 20% by weight with respect to the weight of dry gelatin in the photographic element.

5. A light-sensitive silver halide photographic element of claim 1, wherein the carbamoyl pyridinium salt compound is added in an amount of 0.2 to 10% by weight with respect to the weight of dry gelatin in the photographic element.

6. A light-sensitive silver halide photographic element of claim 1, wherein the carbamoyl pyridinium salt compound is also in a layer different from said protective layer.

* * * * *

UNITED STATES PATENT AND TRADEMARK OFFICE

CERTIFICATE OF CORRECTION

PATENT NO. : 5,529,892

DATED : June 25, 1996

INVENTOR(S) : Sergio Massirio, Giovanni Giusto, Domenico Marinelli

It is certified that error appears in the above-indentified patent and that said Letters Patent is hereby corrected as shown below:

Column 17

Yellow Dye Forming Coupler Y-1:

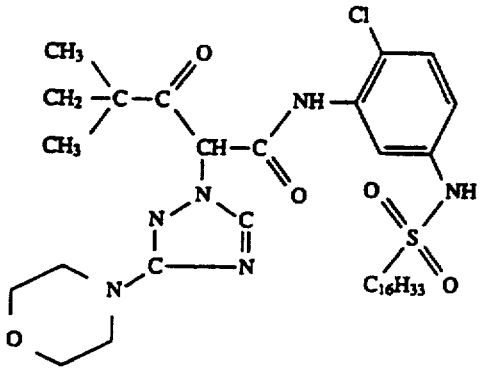

Yellow Dye Forming Coupler Y-1:

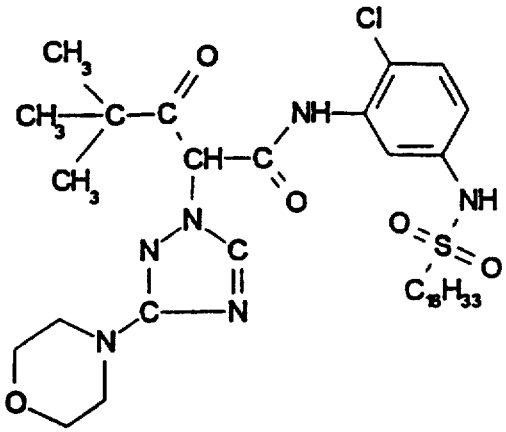

Signed and Sealed this

First Day of April, 1997

*Attest:*

BRUCE LEHMAN

*Attesting Officer*

*Commissioner of Patents and Trademarks*